US006895395B1

(12) United States Patent
Blanluet et al.

(10) Patent No.: US 6,895,395 B1
(45) Date of Patent: May 17, 2005

(54) POSTAL PRINTING DEVICE WITH FACILITATED READING

(75) Inventors: Patrick Blanluet, Paris (FR); Pascal Charroppin, Le Vesinet (FR)

(73) Assignee: Neopost Industrie, Paris (FR)

( * ) Notice: Subject to any disclaimer, the term of this patent is extended or adjusted under 35 U.S.C. 154(b) by 0 days.

(21) Appl. No.: 09/428,058

(22) Filed: Oct. 27, 1999

(30) Foreign Application Priority Data

Oct. 28, 1998 (FR) ..... 98 13500

(51) Int. Cl.[7] ..... G07B 17/00; B41J 2/245; B41J 2/15; B41J 23/00; B41J 29/38

(52) U.S. Cl. ..... 705/408; 705/401; 705/410; 347/14; 347/37; 347/40; 347/41; 400/61; 400/103; 400/104; 400/106; 400/279

(58) Field of Search ..... 705/401, 408, 705/410; 347/14, 37, 40, 41; 400/61, 103, 104, 106, 279; 364/518, 1.1

(56) References Cited

U.S. PATENT DOCUMENTS 4,649,266 A 3/1987 Eckert
4,862,386 A * 8/1989 Axelrod et al. ..... 235/375
5,070,345 A * 12/1991 Lahut et al. ..... 347/41
5,769,550 A * 6/1998 Brand et al. ..... 400/279
5,946,011 A * 8/1999 Kanaya ..... 347/41

FOREIGN PATENT DOCUMENTS

| | | |
|---|---|---|
| EP | 0 076 948 A2 | 4/1983 |
| EP | 0 702 334 A1 | 3/1996 |
| EP | 0 702 335 A1 | 3/1996 |
| FR | 0702334 A1 * | 3/1996 |

* cited by examiner

*Primary Examiner*—James P. Trammell
*Assistant Examiner*—Daniel L. Greene
(74) *Attorney, Agent, or Firm*—Sughrue Mion, PLLC

(57) ABSTRACT

This invention relates to an inkjet printing device of a franking machine intended to print postal indicia on a mail piece to be franked, displaced with respect to this device in a direction of displacement, the postal indicia comprising at least an amount of franking, a date of deposit and an authentication code and the printing device comprising, on the one hand, a plurality of nozzles for ejecting ink droplets, disposed in two rows extending transversely to the direction of displacement, these two rows of nozzles being spaced apart from each other by a distance in this direction and, on the other hand, a control means for selectively controlling the ejection of these ink droplets as a function of the postal indicia to be printed, said control means being arranged so that, during printing, each of the critical postal data such as the amount of franking, the date of deposit or the authentication code, is printed from one row of nozzles.

19 Claims, 2 Drawing Sheets

POSTAL PRINTING DEVICE WITH FACILITATED READING

FIELD OF THE INVENTION

The present invention relates to the exclusive domain of processing mail, and more particularly to a printing process and device in a franking machine of inkjet type.

BACKGROUND OF THE INVENTION

An inkjet franking machine is disclosed in U.S. Pat. No. 5,083,153. Inkjet printing renders franking machines highly versatile, in particular when it is question of printing on the articles for mailing postal indicia comprising both variable characters, such as the numerical values of an amount of postage, and arrangements of colours such as those of advertizing logos.

Due to the dimensions of the indicia to be printed and those of the bars (or casings) of ink ejection nozzles currently available on the market, it has proved that printing of such indicia can be carried out at the present time under acceptable economic conditions, only from two offset rows of ejection nozzles. The printing faults (particularly connection in the median part) due to the relatively imprecise positioning of these rows (however, Applicants have proposed in French Applications FR 2 724 591 and FR 2 724 592 appropriate methods for adjusting in situ before printing in order to obtain a perfect alignment of the nozzles of the two boxes), accentuated by the shocks provoked by the conveyor rollers on the article for mailing during transport thereof, certainly raise acute problems in mail processing. In effect, in this particular technical domain, the indicia includes critical postage data such as the amount of franking which represents a monetary value and no fault affecting this value, however small, can be accepted by the Postal Service. Moreover, with the introduction of so-called "intelligent" indicia, integrated coded information, there is the problem of authentication and checking of this information. In effect, verification and validity of the indicia lies with the recognition of this coded information as well, possibly, as other information shown clear on the indicia (date or machine number for example) and an error in reading resulting from misaligned connections may have damaging consequences as to the validity finally recognized of the article for mailing.

It is an object of the present invention to overcome the problems set forth hereinabove by proposing an improved printing process which avoids, at least at the level of the critical postal data, misaligned connections of the ejection nozzles of the printing device of an inkjet franking machine. One object of the invention is to eliminate such misaligned connections without notably increasing the structure of the printing device. Another object of the invention is to facilitate subsequent recognition of the critical postal data by the Postal Service.

SUMMARY OF THE INVENTION

To that end, the invention relates to a process for printing postal indicia on a mail piece to be franked, displaced with respect to a printing device of an inkjet franking machine in a direction of displacement F, the postal indicia comprising at least an amount of franking, a date of deposit and an authentication code and the printing device comprising a plurality of nozzles for ejecting droplets of ink disposed in two rows extending transversely to the direction of displacement and spaced from each other by a distance D in this direction and a control means for selectively controlling the ejection of these ink droplets as a function of the indicia to be printed, process characterized in that each of the critical postal data, such as the amount of franking, the date of deposit or the authentication code is printed from one row of nozzles.

This process eliminates the misaligned connections previously affecting the date of deposit and the amount of franking, the reliability of the reading of these data consequently being increased. In addition, taking into account the fact that the critical postal data can no longer be disposed in the zone of connection of the two rows of ejection nozzles, an adjustment in situ of the alignment is no longer indispensable.

According to an advantageous characteristic, at least the end nozzles of the two rows of ejection nozzles, disposed at the level of a median part of the postal indicia, are de-activated, in order to avoid a possible overlapping during printing.

Certain determined ejection nozzles are selectively de-activated in order to allow printing at a lower resolution of the data other than that relative to said critical postal indicia. Thanks to this characteristic, the speed of printing is increased and the cost of the indicia is decreased by reducing the quantity of ink ejected.

The invention also relates to an inkjet printing device of a franking machine intended to print postal indicia on a mail piece to be franked, displaced with respect to this device in a direction of displacement F, the postal indicia comprising at least an amount of franking, a date of deposit and an authentication code and the printing device comprising a plurality of nozzles for ejecting ink droplets, disposed in two rows extending transversely to the direction of displacement, these two rows of nozzles being spaced apart from each other by a distance D in this direction and a control means for selectively controlling the ejection of these ink droplets as a function of the postal indicia to be printed, said device being characterized in that said control means is arranged so that, during printing, each of the critical postal data such as the amount of franking, the date of deposit or the authentication code, is printed from one row of nozzles.

At least the end nozzles of the two rows of ejection nozzles disposed at the level of a median part of the postal indicia are preferably de-activated in order to avoid an overlapping during printing. Certain determined ejection nozzles are advantageously de-activated to allow a print at a lower resolution of the data other than that relative to said critical postal data.

BRIEF DESCRIPTION OF THE DRAWINGS

The invention will be more readily understood on reading the following description given by way of non-limiting example, with reference to the accompanying drawings, in which.

DESCRIPTION OF PREFERRED EMBODIMENT

Figure 1:
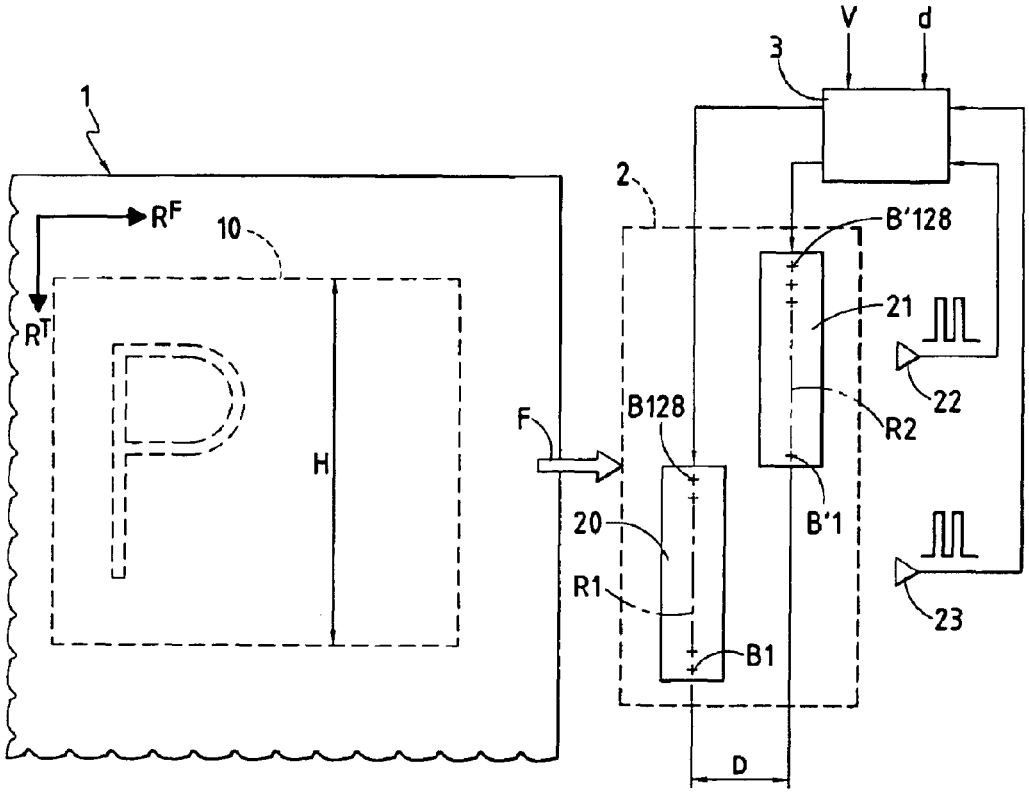
FIG. 1 is a simplified block diagram of the printing means of a franking machine.

Referring now to the drawings, and firstly to FIG. 1, the franking machine shown therein conventionally comprises a conveying system (not shown) which displaces, in a direction of displacement F, the mail piece 1 to be franked (an envelope or a label, for example) beneath a stationary ink-jet printing head 2.

This printing device comprises two casings 20, 21 each comprising a row of nozzles R1, R2 (the nozzles are represented by crosses), these two rows of nozzles being mounted in the printing device 2 so that they extend transversely to the direction of displacement F, the two casings being offset with respect to each other both transversely and longitudinally with respect to this direction F (by a distance D).

The presence of these two casings is imposed at the present time for technical and commercial reasons. In effect, the dimensions of the standard, and therefore low-cost, rows of nozzles are today limited to only half an inch (12.7 mm) while the height of postal indicia is currently close to 25 mm. These ink-jet printing casings have variable resolutions currently ranging from about 200 nozzles per inch (viz. one nozzle every 0.127 mm) to 600 nozzles per inch (1 nozzle every 0.042 mm), which is perfect for printing postal indicia.

The arrangement of the two casings 20 and 21 is such that the distance between the last nozzle B'128 (the uppermost one in FIG. 1) of the casing 21 and the first nozzle B1 (the lowermost one in FIG. 1) of casing 20 is at least equal to the height H of the postal indicia 10 represented by the rectangle in broken lines on article 1. In addition, these two casings 20, 21 are mounted if possible so that the last nozzle B128 of the casing 20 (that of casing 20 uppermost in FIG. 1) is spaced apart from the first nozzle B'1 of the casing 21 (that of the casing 21 lowermost in FIG. 1), in the direction perpendicular to direction F, by a distance equal to the distance between two consecutive nozzles of one or the other of the rows of nozzles.

The franking machine further comprises a control means 3, advantageously comprising a microprocessor and a programme recorded in a memory (not shown) associated therewith, which is arranged in order selectively to control (as a function of the postal indicia to be printed) the chronological succession of the ejections of droplets of ink of the different nozzles, in response to a clock signal 22, 23 synchronized or not with a speed of displacement of the article of mail beneath the printing head 2, so that it is possible to produce dots on this article which join each other with slight overlap along straight lines parallel to direction F.

In order to print a linear mark transverse to direction F and which extends over almost the whole height H of the indicia 10 (like the bar of the letter P shown in FIG. 1) the unit 3 delays the control of ejection of droplets of ink from the nozzles of row R2 (the nozzles of casing 21 which is the most downstream in direction F), with respect to the control of ejection of the droplets of ink from the nozzles of row R1 (the nozzles of casing 20 which is the most upstream in direction F), by a delay R varying as a function of the ratio d/V where d is a datum of adjustment previously recorded in the memory and representative of distance D.

However, due to the tolerances of the casing designers, the distance D varies from one printing device to the other and it is, in principle, necessary to adjust it after assembly of the casings 20 and 21 in the franking machine, for example by resorting to the methods of adjustment before printing mentioned above, developed by Applicants.

Figure 2:
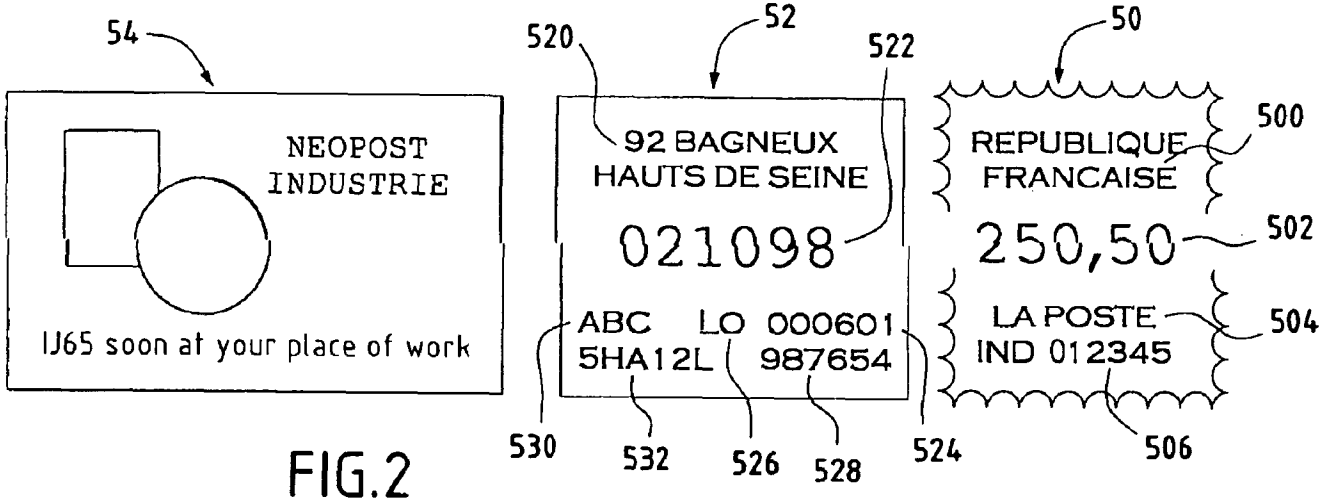
FIG. 2 shows postal indicia printed by conventional means.

FIG. 2 illustrates French postal indicia in the absence of initial adjustment or in the case of defective adjustment or adjustment due to usage. The misaligned connections have been voluntarily exaggerated for explanatory purposes. The indicia is constituted by three distinct zones. The first zone 50 corresponds to the stamp proper, the second zone 52 corresponds to the date stamp and the third zone 54 corresponds to the advertising logo. In a preferred configuration, the stamp comprises a mention 500 of the State of issue "REPUBLIQUE FRANCAISE", an amount of franking 502, a mention 504 of the Postal Service concerned (LA POSTE) and a postal number 506 of the machine having effected franking. Similarly, the date stamp comprises the details 520 of the establishment where the mail is deposited, a date of deposit 522, a number of article 524, a category of article 526, a number of establishment of deposit 528, a redundant code 530 for verification of the quality of printing and a code 532 for authentication of the indicia. As for the configuration of the advertizing logo, it is left to the imagination of the users of the postal service.

Certain of these different postal franking data are critical, in that their non-recognition, or false recognition, may cause a considerable prejudice both against the Postal Service and the user. Such data concern the amount of franking which represents a monetary value, the date of deposit which must correspond to the effective remittance of the article to the Postal Service, the code of verification which allows control of the optical reading and of the coded authentication information which guarantees the integrity of the postal data forming the indicia.

As shown in this FIG. 2, both the amount of franking and the date of deposit are arranged in a median part of the indicia and are therefore particularly affected by any misaligned connections of the two rows of ejection nozzles. In effect, the date of deposit, like the amount of franking, are printed both by row R1 of the ejection nozzles (for the lower half of these postal data) and by row R2 of the ejection nozzles (for the upper half). In addition, the verification and authentication codes are hardly distinguished from the other postal data of the date stamp zone 52, which does not facilitate reading thereof.

Figure 3:
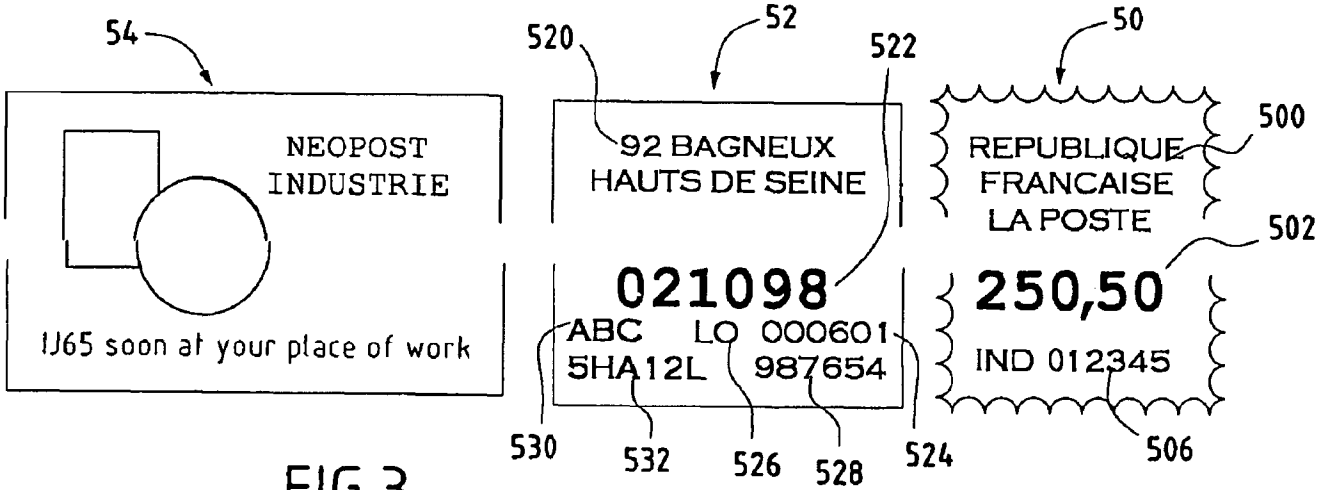
FIG. 3 shows postal indicia printed by printing means according to the invention.

According to the invention, and as illustrated in FIG. 3, it is proposed that the printing of these critical postal data be effected by one row of ejection nozzles, advantageously the lower row R1. In this way, any misaligned connections between the two rows of ejection nozzles cannot affect these essential data, but only the frame of the date stamp zone 52 or the advertizing logo zone 54 which are located in the median part of the indicia, at the level of a zone of overlap of these two rows. In addition, it will be noted that the possible overlap of the printing at the level of this median part, which may occur if the distance between the end nozzles (B128 and B'1) of the two casings 20, 21, in the direction perpendicular to F, is shorter than the distance between two successive ejection nozzles of the same casing, may be avoided by proceeding with a de-activation of these two end nozzles. A selective de-activation of the adjacent nozzles may advantageously also be envisaged, particularly at the level of the different frames of the indicia.

Moreover, in order to facilitate recognition/control of these critical postal data, they are provided to be printed at a resolution higher than a standard resolution of print of the other postal data of the indicia. The information thus provided at a high resolution presents a better contrast and stands out better from the indicia, which facilitates optical reading thereof. FIG. 3 gives an example thereof, with the amount of franking 502, date of deposit 522, verification code 530 and authentication code 532. For the information data (non-postal data), such as those figuring on the advertizing logo zone 54, printing may, on the contrary, be provided at a resolution lower than this standard resolution.

Such modification of the print resolution may be obtained in two orthogonal directions T and F (cf. FIG. 1) from sub-multiples of a determined maximum resolution ($R^T$, $R^F$), by selectively controlling the activation or de-activation of certain nozzles. For example, if the high-resolution print is effected at resolution ($R^T$, $R^F$), the standard print may be made at resolution ($R^T$, $R^F$*2/3) and the low-resolution print at resolution ($R^T$, $R^F$/2).

Therefore, with $R_T$=300 dpi and $R_T$=450 dpi, it becomes possible to print the different postal data, critical or not, or information, at the following three resolutions:

300*450 at high resolution (critical postal data)

300*300 at standard resolution (other postal data)

300*225 at low resolution (information data).

It will be noted that the reduction of the resolution presents the advantage of allowing an increase in the overall speed of printing of the indicia and a reduction in the consumption of ink (consequently with a reduction in the cost price of printing an indicia) as well as a reduction in the time for this ink to dry (which avoids smudging with certain types of support).

What is claimed is:

1. Process for printing postal indicia on a mail piece to be franked, the mail piece being displaced with respect to an inkjet printing device of a franking machine in a direction of displacement, the postal indicia comprising at: least an amount of franking, a date of deposit, and an authentication code, the printing device comprising a plurality of nozzles for ejecting droplets of ink disposed in two rows extending transversely to the direction of displacement and spaced from each other along the direction of displacement, and a control means for controlling the ejection of these ink droplets, the process comprising:

controlling the ejection of the ink droplets from the two rows of nozzles as a function of the indicia to be printed; and printing each of the amount of franking, the date of deposit, and the authentication code from only one of the two rows of nozzles.

2. The process of printing of claim 1, wherein at least the end nozzles of the two rows of ejection nozzles, disposed at the level of a median part of the indicia, are selectively de-activated in order to avoid a possible overlap during printing.

3. The process of printing of claim 1, wherein certain determined ejection nozzles are selectively de-activated in order to allow printing at a lower resolution of data other than that relative to said amount of franking, the date of deposit and the authentication code.

4. Inkjet printing device of a franking machine for printing postal indicia on a mail piece to be franked, disposed with respect to this device in a direction of displacement, the postal indicia comprising at least a franking amount, a date of deposit, and an authentication code, the printing device comprising: a plurality of nozzles for ejecting ink droplets, disposed in two rows extending transversely to the direction of displacement, these two rows of nozzles being spaced apart from each other by a distance in the direction of displacement, and a control means for selectively controlling the ejection of these ink droplets as a function of the postal indicia to be printed, wherein said control means operates so that, during printing, each of the amount of franking, the date of deposit and the authentication code, is printed from only one of the two rows of nozzles.

5. The printing device of claim 4, wherein at least the end nozzles of the two rows of ejection nozzles disposed at the level of a median part of the postal indicia are deactivated in order to avoid an overlapping during printing.

6. The printing device of claim 4, wherein certain determined ejection nozzles are de-activated to allow printing at a lower resolution of data other than that relative to said amount of franking, the date of deposit and the authentication code.

7. The process of printing of claim 1, wherein the amount of franking, the date of deposit, and the authentication code are each printed by the same row of nozzles.

8. The printing device of claim 4, wherein the amount of franking, the date of deposit, and the authentication code are each printed by the same row of nozzles.

9. In a franking device having separate first and second rows of plural ink nozzles, said first and second rows of ink nozzles extending transversely to a direction of displacement of a mail piece relative to the franking device and being displaced from each other along said direction of displacement, a process for printing postal indicia on the mail piece comprising:

printing complete critical postal indicia using only one of said first and second rows of ink nozzles; and printing non-critical postal indicia using both of said first and second rows of ink nozzles in combination.

10. The process according to claim 9, wherein printing non-critical postal indicia using both of said first and second rows of ink nozzles in combination comprises deactivating some of the ink nozzles at respective medial ends, relative to the non-critical postal indicia, of the first and second rows of ink nozzles.

11. The process according to claim 9, further comprising printing the critical postal indicia at a resolution higher than that of the non-critical postal indicia.

12. The process according to claim 9, wherein the critical postal indicia comprise one or more of an amount of franking, a date of deposit, an authentication code.

13. The process according to claim 9, where the non-critical postal indicia comprise advertising.

14. The process according to claim 12, wherein printing the one or more complete critical postal indicia comprises using the same one of said first and second rows of ink nozzles.

15. A printing device for a franking machine, comprising:

first and second rows of plural ink nozzles; and control means for selectively operating only one of the first and second rows of plural ink nozzles to print complete critical postal indicia.

16. The device according to claim 15, wherein critical postal indicia include one or more of an amount of franking, a date of deposit, and an authentication code.

17. The device according to claim 16, wherein selectively operating only one of the first and second rows of plural ink nozzles to print complete critical postal indicia comprises selectively using the same one of the first and second rows of nozzles to print complete critical postal indicia.

18. The device according to claim 15, wherein said control means is additionally for selectively operating both of the first and second rows of nozzles in combination to print non-critical postal indicia.

19. The device according to claim 15, wherein said control means comprises a microprocessor.

* * * * *